US012378963B2

(12) United States Patent
Hattori et al.

(10) Patent No.: US 12,378,963 B2
(45) Date of Patent: Aug. 5, 2025

(54) MOTOR-DRIVEN SCROLL ELECTRIC COMPRESSOR

(71) Applicant: KABUSHIKI KAISHA TOYOTA JIDOSHOKKI, Kariya (JP)

(72) Inventors: Yuya Hattori, Kariya (JP); Takumi Maeda, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 116 days.

(21) Appl. No.: 18/205,177

(22) Filed: Jun. 2, 2023

(65) Prior Publication Data

US 2023/0392599 A1 Dec. 7, 2023

(30) Foreign Application Priority Data

Jun. 6, 2022 (JP) ..... 2022-091658

(51) Int. Cl.
*F04C 27/00* (2006.01)
*F04C 18/02* (2006.01)
*F04C 23/02* (2006.01)

(52) U.S. Cl.
CPC ..... *F04C 27/009* (2013.01); *F04C 18/0215* (2013.01); *F04C 23/02* (2013.01); *F04C 2240/50* (2013.01)

(58) Field of Classification Search
CPC .... F04C 27/009; F04C 18/0215; F04C 23/02; F04C 2240/50; F04C 2240/30;
(Continued)

(56) References Cited

U.S. PATENT DOCUMENTS 4,210,339 A * 7/1980 Povejsil ..... F16J 15/3232 277/560
4,755,115 A 7/1988 Akaike
(Continued)

FOREIGN PATENT DOCUMENTS

EP 3276173 A1 * 1/2018
EP 3450754 A1 * 3/2019 ..... F04B 1/148
(Continued)

OTHER PUBLICATIONS

Communication issued Apr. 15, 2025 in Japanese Application No. 2022-091658.

*Primary Examiner* — Dominick L Plakkoottam
(74) *Attorney, Agent, or Firm* — Sughrue Mion, PLLC

(57) ABSTRACT

A motor-driven scroll type compressor that includes: a housing; a rotary shaft; an electric motor; and a compression part including a fixed scroll and an orbiting scroll. The housing includes a separation wall separating a back pressure chamber from a motor chamber. The separation wall includes a bearing and a seal member having an inner circumference seal portion and an outer circumference seal portion. The seal member seals the back pressure chamber and the motor chamber. An end of the inner circumference seal portion is provided closer to the bearing than an end of the outer circumference seal portion is. The separation wall includes a holding portion being in contact with the end of the outer circumference seal portion to restrict movement of the seal member toward the bearing. The end of the inner circumference seal portion is provided closer to the bearing than the holding portion is.

5 Claims, 2 Drawing Sheets

(58) Field of Classification Search
CPC .. F04C 2240/80; F04C 23/008; F04C 27/005; F04C 29/02; F04C 15/0038; F04C 18/02; F04C 18/0207; F04C 18/0246; F04C 27/001; F04C 2240/56; F04C 27/00; F04C 27/003; F04C 15/0046
See application file for complete search history.

(56) References Cited

U.S. PATENT DOCUMENTS

| | | | | |
|---|---|---|---|---|
| 12,158,209 | B2 * | 12/2024 | Yasuda | F16J 15/3232 |
| 2007/0103015 | A1 | 5/2007 | Koide et al. | |
| 2013/0094987 | A1 * | 4/2013 | Yamashita | F04C 29/023 418/55.3 |
| 2015/0285390 | A1 * | 10/2015 | Grau | F16K 17/04 277/502 |
| 2019/0264689 | A1 | 8/2019 | Park et al. | |
| 2020/0212760 | A1 * | 7/2020 | Hattori | F04D 29/266 |
| 2020/0309126 | A1 * | 10/2020 | Hattori | F04C 28/24 |
| 2020/0309127 | A1 * | 10/2020 | Koike | F04C 29/0021 |
| 2021/0062808 | A1 * | 3/2021 | Hattori | F04C 18/0215 |
| 2021/0062811 | A1 * | 3/2021 | Yamashita | F04C 23/008 |

FOREIGN PATENT DOCUMENTS

| | | | | |
|---|---|---|---|---|
| JP | 61-169288 | U | 10/1986 | |
| JP | 62-59366 | U | 4/1987 | |
| JP | 5-57520 | U | 7/1993 | |
| JP | 2007-128756 | A | 5/2007 | |
| KR | 20130092872 | A * | 8/2013 | |
| WO | WO-2018139543 | A1 * | 8/2018 | F04C 18/0207 |

* cited by examiner

MOTOR-DRIVEN SCROLL ELECTRIC COMPRESSOR

CROSS-REFERENCE TO RELATED APPLICATION

This application claims priority to Japanese Patent Application No. 2022-091658 filed on Jun. 6, 2022, the entire disclosure of which is incorporated herein by reference.

BACKGROUND ART

The present disclosure relates to a motor-driven scroll type compressor.

A motor-driven scroll type compressor includes a housing, a rotary shaft rotationally supported in the housing, an electric motor rotating the rotary shaft, and a compression part. The compression part includes a fixed scroll fixed to the housing, and an orbiting scroll revolving in response to the rotation of the rotary shaft while being meshed with the fixed scroll. The housing includes a separation wall that separates a back pressure chamber applying back pressure to urge the orbiting scroll toward the fixed scroll from a motor chamber accommodating the electric motor. The separation wall includes an insertion hole into which the rotary shaft is inserted. The separation wall further includes a bearing that rotationally supports the rotary shaft, and a seal member that has an annular shape and seals the back pressure chamber and the motor chamber. The seal member has an inner circumference seal portion sealing a gap between the inner circumference seal portion and the rotary shaft, and an outer circumference seal portion sealing a gap between the outer circumference seal portion and the separation wall. In the motor-driven scroll type compressor disclosed in Japanese Patent Application Publication No. 2007-128756, movement of the seal member is regulated by a circlip.

In a motor-driven scroll type compressor, in addition to suppression of movement of a seal member, downsizing of a dimension of a rotary shaft in the axial direction thereof has been desired.

SUMMARY

In accordance with an aspect of the present disclosure, there is provided a motor-driven scroll type compressor that includes: a housing; a rotary shaft rotationally supported in the housing; an electric motor rotating the rotary shaft; and a compression part including a fixed scroll fixed to the housing and an orbiting scroll revolving in response to the rotation of the rotary shaft while being meshed with the fixed scroll. The housing includes a separation wall separating a back pressure chamber from a motor chamber accommodating the electric motor, the back pressure chamber from which a back pressure for urging the orbiting scroll toward the fixed scroll is applied. The separation wall has an insertion hole into which the rotary shaft is inserted. The separation wall includes: a bearing rotationally supporting the rotary shaft, and a seal member that has an annular shape and includes an inner circumference seal portion sealing a gap between the inner circumference seal portion and the rotary shaft and an outer circumference seal portion sealing a gap between the outer circumference seal portion and the separation wall. The seal member seals the back pressure chamber and the motor chamber. Each of the inner circumference seal portion and the outer circumference seal portion has an end directed toward the bearing. The end of the inner circumference seal portion is provided closer to the bearing than the end of the outer circumference seal portion is. The separation wall includes a holding portion that faces and is in contact with the end of the outer circumference seal portion to restrict movement of the seal member toward the bearing. The end of the inner circumference seal portion is provided closer to the bearing than the holding portion is.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Hereinafter, a motor-driven scroll type compressor according to an embodiment will be described with reference to drawings. The motor-driven scroll type compressor of the present embodiment is used for a vehicle air conditioner, for example.

Basic Configuration of Motor-Driven Scroll Type Compressor

Figure 1:
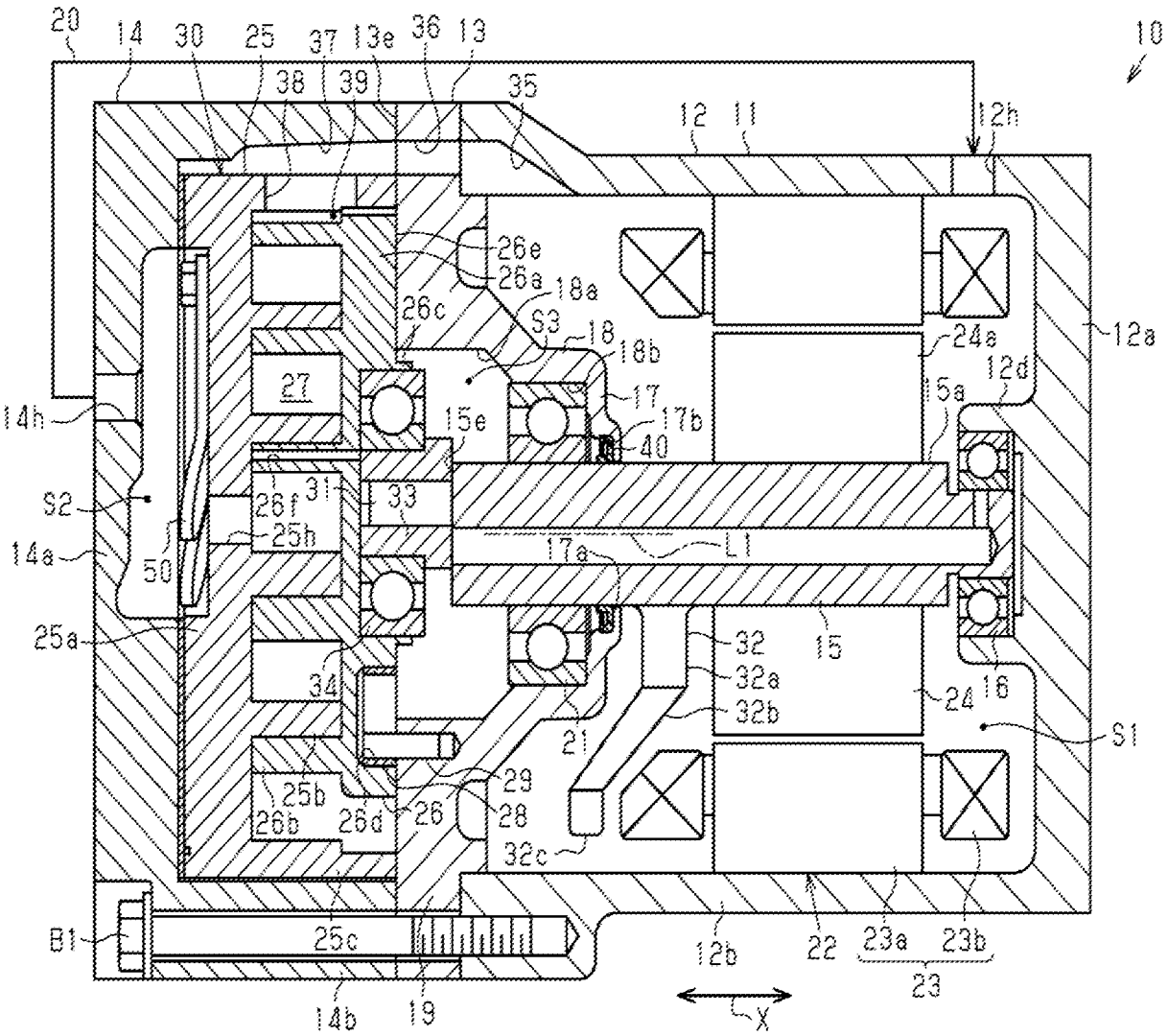
FIG. 1 is a cross-sectional view of a motor-driven scroll type compressor according to an embodiment.

As illustrated in FIG. 1, a motor-driven scroll type compressor 10 includes a housing 11 having a tubular shape. The housing 11 includes a motor housing 12, a shaft support housing 13, and a discharge housing 14. Each of the motor housing 12, the shaft support housing 13, and the discharge housing 14 is made of a metal material. Each of the motor housing 12, the shaft support housing 13, and the discharge housing 14 is made of aluminum, for example.

The motor-driven scroll type compressor 10 includes a rotary shaft 15 rotationally supported in the housing 11. Hereinafter, a direction in which an axial line L1 of the rotary shaft 15 extends is referred to as an axial direction X of the rotary shaft 15.

The motor housing 12 includes an end wall 12*a* having a plate shape and a peripheral wall 12*b* having a tubular shape. The peripheral wall 12*b* tubularly extends from an outer periphery of the end wall 12*a*. An axial direction of the peripheral wall 12*b* coincides with the axial direction X of the rotary shaft 15. The peripheral wall 12*b* has an inlet 12*h*. The inlet 12*h* is formed at the peripheral wall 12*b* at a position close to the end wall 12*a*. An inside and an outside of the motor housing 12 communicate with each other through the inlet 12*h*. Refrigerant gas serving as fluid is drawn from the inlet 12*h*.

The motor housing 12 includes a boss portion 12*d* having a cylindrical shape. The boss portion 12*d* protrudes from an inner surface of the end wall 12*a*. A first end portion that is one end portion of the rotary shaft 15 in the axial direction X is inserted in the boss portion 12*d*. A rolling bearing 16 is provided between an inner circumferential surface of the boss portion 12*d* and an outer peripheral surface 15*a* of the rotary shaft 15 at the first end portion. The first end portion of the rotary shaft 15 is rotationally supported in the motor housing 12 via the rolling bearing 16.

The shaft support housing 13 includes an end wall 17 having a disc shape and a peripheral wall 18 having a cylindrical shape. The peripheral wall 18 tubularly extends from an outer periphery of the end wall 17. An axial direction of the peripheral wall 18 coincides with the axial direction X of the rotary shaft 15. The shaft support housing 13 includes a flange wall 19 having an annular shape. The flange wall 19 extends toward a radially outward side of the rotary shaft 15 from an end portion of the outer circumferential surface of the peripheral wall 18 opposite to the end wall 17 of the outer circumferential surface of the peripheral wall 18. An outer periphery of the flange wall 19 is in contact with an open end of the peripheral wall 12*b* of the motor housing 12.

The peripheral wall 18 has a peripheral wall recess 18*a* and a first accommodation recess 18*b*. The end wall 17 has an insertion hole 17*a*. That is, the insertion hole 17*a* is formed in the shaft support housing 13. The end wall 17 has a second accommodation recess 17*b*. An axial direction of each of the peripheral wall recess 18*a*, the first accommodation recess 18*b*, the insertion hole 17*a*, and the second accommodation recess 17*b* coincides with the axial direction X of the rotary shaft 15.

The peripheral wall recess 18*a* is opened at an end surface 13*e* that is one end surface of the shaft support housing 13 opposite to the motor housing 12. The first accommodation recess 18*b* is adjacent to the peripheral wall recess 18*a* in the axial direction X of the rotary shaft 15 and communicates with the peripheral wall recess 18*a*. The second accommodation recess 17*b* is adjacent to the first accommodation recess 18*b* in the axial direction X of the rotary shaft 15 and communicates with the first accommodation recess 18*b*. The insertion hole 17*a* is adjacent to the second accommodation recess 17*b* in the axial direction X of the rotary shaft 15 and communicates with the second accommodation recess 17*b*.

Figure 2:
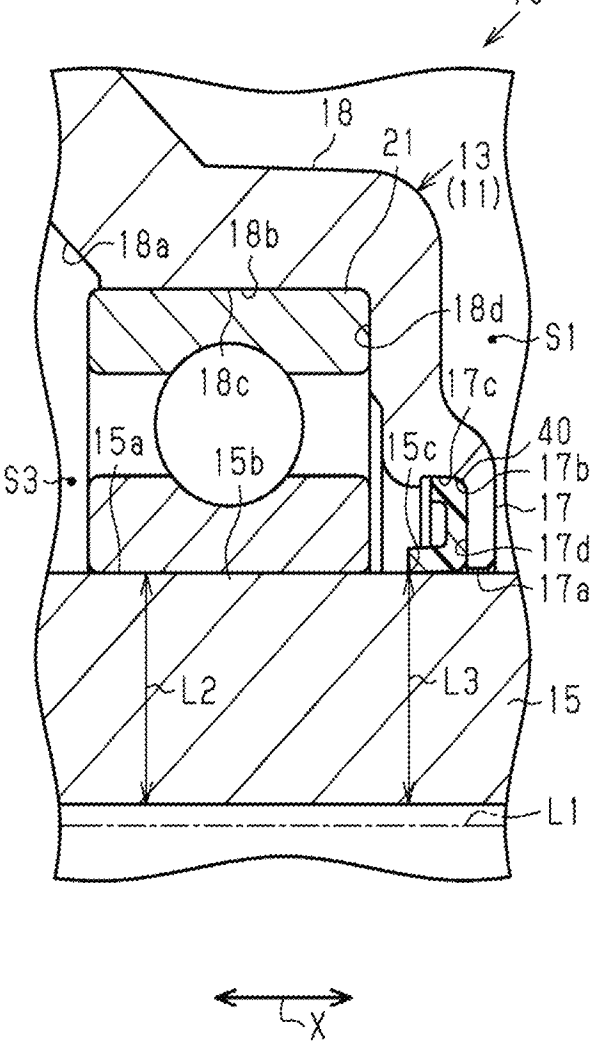
FIG. 2 is an enlarged cross-sectional view of a part of a motor-driven scroll type compressor.

As illustrated in FIG. 2, the first accommodation recess 18*b* is defined by a first side surface 18*c* and a first end surface 18*d* of the peripheral wall 18. The first end surface 18*d* extends perpendicularly to the axial direction X of the rotary shaft 15. The first side surface 18*c* extends from an outer edge portion of the first end surface 18*d* in a radial direction of the rotary shaft 15. The second accommodation recess 17*b* is defined by a second side surface 17*c* and a second end surface 17*d* of the end wall 17. The second end surface 17*d* extends perpendicularly to the axial direction X of the rotary shaft 15. The second side surface 17*c* extends from an outer edge portion of the second end surface 17*d* in the radial direction of the rotary shaft 15.

The insertion hole 17*a* is formed at a central portion of the end wall 17. The insertion hole 17*a* extends through the end wall 17 in a thickness direction thereof. The rotary shaft 15 is inserted into the insertion hole 17*a*. An end surface 15*e* is positioned inside the peripheral wall 18, at a second end portion of the rotary shaft 15 that is the other end portion of the rotary shaft 15 and opposite to the first end portion of the rotary shaft 15. The second end portion of the rotary shaft 15 inserted into the insertion hole 17*a* is positioned inside the first accommodation recess 18*b* through the insertion hole 17*a* and the second accommodation recess 17*b*.

As illustrated in FIG. 1, a motor chamber S1 is formed in the housing 11. The motor chamber S1 is defined by the motor housing 12 and the shaft support housing 13. The motor chamber S1 communicates with the inlet 12*h*. The refrigerant gas from the inlet 12*h* is drawn into the motor chamber S1.

The motor-driven scroll type compressor 10 includes an electric motor 22 rotating the rotary shaft 15. The motor chamber S1 accommodates the electric motor 22. The electric motor 22 includes a stator 23 having a tubular shape and a rotor 24 having a tubular shape. The rotor 24 is disposed inside the stator 23. The rotor 24 rotates integrally with the rotary shaft 15. The stator 23 surrounds the rotor 24. The rotor 24 includes a rotor core 24*a* fixed to the rotary shaft 15, and a plurality of permanent magnets (not illustrated) provided in the rotor core 24*a*. The stator 23 includes a stator core 23*a* having a tubular shape and a coil 23*b*. The stator core 23*a* is fixed to an inner circumferential surface of the peripheral wall 12*b* of the motor housing 12. The coil 23*b* is wound around the stator core 23*a*. Electric power controlled by an inverter (not illustrated) is supplied to the coil 23*b* to rotate the rotor 24. As a result, the rotary shaft 15 rotates integrally with the rotor 24.

The discharge housing 14 has an end wall 14*a* having a plate shape and a peripheral wall 14*b* having a tubular shape. The peripheral wall 14*b* tubularly extends from an outer periphery of the end wall 14*a*. An axial direction of the peripheral wall 14*b* coincides with the axial direction X of the rotary shaft 15. An open end of the peripheral wall 14*b* is in contact with the outer periphery of the flange wall 19.

The discharge housing 14, the shaft support housing 13, and the motor housing 12 are fixed to each other via a bolt B1. The bolt B1 extends through the peripheral wall 14*b* of the discharge housing 14 and the outer periphery of the flange wall 19, and is screwed into the peripheral wall 12*b* of the motor housing 12. As a result, the shaft support housing 13 is coupled to the peripheral wall 12*b* of the motor housing 12, and the discharge housing 14 is coupled to the flange wall 19 of the shaft support housing 13. Thus, the motor housing 12, the shaft support housing 13, and the discharge housing 14 are arranged in this order in the axial direction X of the rotary shaft 15.

The motor-driven scroll type compressor 10 includes a discharge chamber S2. The discharge chamber S2 is formed in the discharge housing 14. The discharge housing 14 has an outlet 14*h*. The outlet 14*h* is formed at the end wall 14*a* of the discharge housing 14. The outlet 14*h* communicates with the discharge chamber S2. The refrigerant gas in the discharge chamber S2 is drawn from the outlet 14*h*.

The outlet 14*h* and the inlet 12*h* are connected to each other through an external refrigerant circuit 20. The external refrigerant circuit 20 includes a condenser, an expansion valve, and an evaporator (not illustrated). The refrigerant gas discharged from the outlet 14*h* flows through the external refrigerant circuit 20. The refrigerant gas flowing through the external refrigerant circuit 20 passes through the condenser, the expansion valve, and the evaporator, and is returned to the motor chamber S1 via the inlet 12*h*. The motor-driven scroll type compressor 10 and the external refrigerant circuit 20 form a vehicle air conditioner.

The motor-driven scroll type compressor 10 includes a compression part 30. The compression part 30 includes a fixed scroll 25 and an orbiting scroll 26. The fixed scroll 25 and the orbiting scroll 26 are arranged inside the peripheral wall 14*b* of the discharge housing 14. The fixed scroll 25 is positioned closer to the end wall 14*a* than the orbiting scroll 26 is, in the axial direction X of the rotary shaft 15.

The fixed scroll 25 is fixed to the housing 11. Specifically, the fixed scroll 25 is fixed to the end wall 14*a* of the discharge housing 14. The fixed scroll 25 has a fixed plate 25*a* and a fixed spiral wall 25*b*. The fixed plate 25*a* has a disc shape. The fixed spiral wall 25*b* extends straight from the fixed plate 25*a* toward a side opposite to the end wall 14*a*. The fixed scroll 25 has a fixed outer peripheral wall 25*c*. The fixed outer peripheral wall 25*c* cylindrically extends straight from an outer periphery of the fixed plate 25*a*. The fixed outer peripheral wall 25*c* surrounds the fixed spiral wall 25*b*. An open end surface of the fixed outer peripheral wall 25*c* is positioned closer to a side opposite to the fixed plate 25*a* than a distal end surface of the fixed spiral wall 25*b* is.

The orbiting scroll 26 includes an orbiting plate 26*a* and an orbiting spiral wall 26*b*. The orbiting plate 26*a* has a disc shape. The orbiting plate 26*a* faces the fixed plate 25*a*. The orbiting spiral wall 26*b* extends straight from the orbiting plate 26*a* toward the fixed plate 25*a*. The orbiting spiral wall 26*b* meshes with the fixed spiral wall 25*b*. As a result, the orbiting scroll 26 revolves by the rotation of the rotary shaft 15 while meshing with the fixed scroll 25. The orbiting spiral wall 26*b* is positioned inside the fixed outer peripheral wall 25*c*. The distal end surface of the fixed spiral wall 25*b* is in contact with the orbiting plate 26*a*. A distal end surface of the orbiting spiral wall 26*b* is in contact with the fixed plate 25*a*. Then, a plurality of compression chambers 27 are defined by the fixed plate 25*a*, the fixed spiral wall 25*b*, the orbiting plate 26*a*, and the orbiting spiral wall 26*b*. Thus, the plurality of compression chambers 27 are defined by the fixed scroll 25 and the orbiting scroll 26. Each of the compression chambers 27 compresses the refrigerant gas.

The orbiting scroll 26 has a boss portion 26*c* having a cylindrical shape. The boss portion 26*c* protrudes from an end surface 26*e* opposite to the fixed plate 25*a* of the orbiting plate 26*a*. An axial direction of the boss portion 26*c* corresponds to the axial direction X of the rotary shaft 15. A plurality of boss-recessed portion 26*d* are formed around the boss portion 26*c* at the end surface 26*e* of the orbiting plate 26*a*. The plurality of boss-recessed portion 26*d* are arranged at predetermined intervals in a circumferential direction of the rotary shaft 15. FIG. 1 illustrates only one boss-recess 26*d* for convenience of explanation. Ring members 28 each having an annular shape are fitted in the boss-recessed portion 26*d*, respectively. The motor-driven scroll type compressor 10 includes a plurality of pins 29. Each of the pins 29 is provided in the shaft support housing 13. Each of the pins 29 protrudes from the end surface 13*e* of the shaft support housing 13. The pins 29 are inserted in the ring members 28, respectively.

A discharge port 25*h* is formed at a central portion of the fixed plate 25*a*. The discharge port 25*h* has a round hole shape. The discharge port 25*h* extends through the fixed plate 25*a* in its thickness direction. A first end of the discharge port 25*h* communicates with the compression chamber 27. A second end of the discharge port 25*h* communicates with the discharge chamber S2. The refrigerant gas compressed in the compression chamber 27 is discharged from the discharge port 25*h* to the discharge chamber S2. A valve mechanism 50 is attached on one surface of the fixed plate 25*a* opposite to the fixed spiral wall 25*b*. The valve mechanism 50 is configured to open and close the discharge port 25*h*.

The motor-driven scroll type compressor 10 includes an eccentric shaft 31. The eccentric shaft 31 protrudes toward the orbiting scroll 26 from a part of the end surface 15*e* of the rotary shaft 15 that is eccentric with respect to an axial line L1 of the rotary shaft 15. The eccentric shaft 31 is formed integrally with the rotary shaft 15. An axial direction of the eccentric shaft 31 coincides with the axial direction X of the rotary shaft 15. The eccentric shaft 31 is inserted in the boss portion 26*c*.

The rotary shaft 15 includes a balance weight 32. The balance weight 32 is formed integrally with the rotary shaft 15. The balance weight 32 is disposed in the rotary shaft 15 at a position eccentric with the axial line L1 of the rotary shaft 15. Specifically, the balance weight 32 is disposed at a position opposite to the eccentric shaft 31 across the axial line L1 of the rotary shaft 15. The balance weight 32 is formed in a substantially fan-shaped plate. The balance weight 32 extends from the rotary shaft 15 toward a radially outward side of the rotary shaft 15. That is, the balance weight 32 extends from the rotary shaft 15 toward the peripheral wall 12*b* of the motor housing 12.

The balance weight 32 is formed of a proximal end 32*a*, an inclined portion 32*b*, and a distal end portion 32*c*. The proximal end 32*a* is connected to the rotary shaft 15 and extends from the rotary shaft 15 so as to be substantially perpendicular to the rotary shaft 15. The inclined portion 32*b* is connected to the proximal end 32*a*. The inclined portion 32*b* obliquely extends so as to approach the shaft support housing 13 as being away from the proximal end 32*a* in the radial direction of the rotary shaft 15. The distal end portion 32*c* is connected to the inclined portion 32*b* and extends substantially perpendicularly to the rotary shaft 15 from the inclined portion 32*b*.

The rotary shaft 15 is disposed in the housing 11, so that the balance weight 32 is positioned inside the motor chamber S1. The balance weight 32 is disposed between the electric motor 22 and the shaft support housing 13 serving as a separation wall in the axial direction X of the rotary shaft 15.

The orbiting scroll 26 is supported by the eccentric shaft 31 so as to be rotatable relative to the eccentric shaft 31 via a bush 33 and a rolling bearing 34. The rotation of the rotary shaft 15 is transmitted to the orbiting scroll 26 via the eccentric shaft 31, the bush 33, and the rolling bearing 34, so that the orbiting scroll 26 rotates. Each of the pins 29 comes in contact with an inner circumferential surface of each of the ring members 28, which prevents the orbiting scroll 26 from rotating and only allows the orbiting scroll 26 to revolve. As a result, the orbiting scroll 26 revolves while the orbiting spiral wall 26*b* is in contact with the fixed spiral wall 25*b* to compress the refrigerant gas in response to reduction of a volume of the compression chamber 27. Thus, the orbiting scroll 26 revolves along with the rotation of the rotary shaft 15. The balance weight 32 is for offsetting a centrifugal force applied to the orbiting scroll 26 in response to the rotation of the rotary shaft 15. Specifically, the balance weight 32 offsets the centrifugal force applied to the orbiting scroll 26 at a time of revolution of the orbiting scroll 26 to reduce an unbalance amount of the orbiting scroll 26.

The motor-driven scroll type compressor 10 includes a plurality of first grooves 35, a plurality of first holes 36, and a plurality of second grooves 37. The plurality of first grooves 35 are formed on an inner circumferential surface of the peripheral wall 12*b* of the motor housing 12. Each of the first grooves 35 is opened at the open end of the peripheral wall 12*b*. The plurality of the first holes 36 are formed at the outer periphery of the flange wall 19 of the shaft support housing 13. Each of the first holes 36 extends through the flange wall 19 in its thickness direction. The first holes 36 communicate with the first grooves 35, respectively. The plurality of the second grooves 37 are formed on the inner circumferential surface of the peripheral wall 14*b* of the discharge housing 14. The second grooves 37 communicate with the first holes 36, respectively. FIG. 1 illustrates one first groove 35, one first hole 36, and one second groove 37 for convenience of explanation.

The fixed scroll 25 includes a plurality of inlet ports 38. FIG. 1 illustrates one inlet port 38 for convenience of explanation. Each of the inlet ports 38 is formed at the fixed outer peripheral wall 25*c* of the fixed scroll 25. Each of the inlet ports 38 extends through the fixed outer peripheral wall 25*c* in its thickness direction. The inlet ports 38 communicate with the second grooves 37, respectively. Two inlet ports 38 are formed at the fixed outer peripheral wall 25*c* at a position spaced by 180 degrees in the circumferential direction of the fixed outer peripheral wall 25*c*, for example.

The motor-driven scroll type compressor 10 includes an inlet chamber 39. The inlet chamber 39 communicates with the two inlet ports 38. The inlet chamber 39 is formed inside the fixed outer peripheral wall 25*c*. The inlet chamber 39 is a space inside the fixed outer peripheral wall 25*c*, communicating with at least one of the two inlet ports 38 along with the revolution of the orbiting scroll 26. The inlet chamber 39 may communicate with one of the two inlet ports 38 without communicating with the other of the two inlet ports 38 depending on the position of the orbiting scroll 26. The inlet chamber 39 may communicate with both the two inlet ports 38 depending on the position of the orbiting scroll 26.

The refrigerant gas inside the motor chamber S1 passes through the first grooves 35, the first holes 36, the second grooves 37, and the inlet ports 38, and is drawn into the inlet chamber 39. The refrigerant gas drawn into the inlet chamber 39 is compressed inside the compression chamber 27 by the revolution of the orbiting scroll 26.

A back pressure chamber S3 is formed inside the housing 11. The back pressure chamber S3 is positioned inside the peripheral wall 18 of the shaft support housing 13. Thus, the back pressure chamber S3 is formed in the housing 11 at a position opposite to the fixed plate 25*a* relative to the orbiting plate 26*a*. The shaft support housing 13 functions as a separation wall separating the back pressure chamber S3 from the motor chamber S1.

A back pressure introduction passage 26*f* is formed in the orbiting scroll 26. The back pressure introduction passage 26*f* extends through the orbiting plate 26*a* and the orbiting spiral wall 26*b*. Part of the refrigerant gas inside the compression chamber 27 is introduced into the back pressure chamber S3 through the back pressure introduction passage 26*f*. A pressure in the back pressure chamber S3 is higher than that in the motor chamber S1 because the part of the refrigerant gas inside the compression chamber 27 is introduced into the back pressure chamber S3 through the back pressure introduction passage 26*f*. A back pressure for urging the orbiting scroll 26 toward the fixed scroll 25 is applied from the back pressure chamber S3. Specifically, an increase in the pressure in the back pressure chamber S3 urges the orbiting scroll 26 toward the fixed scroll 25 such that the distal end surface of the orbiting spiral wall 26*b* is pressed against the fixed plate 25*a*.

Bearing

As illustrated in FIG. 2, a bearing 21 rotationally supporting the rotary shaft 15 is provided in the shaft support housing 13 serving as the separation wall. The bearing 21 of the present embodiment corresponds to a rolling bearing. The bearing 21 is positioned inside the first accommodation recess 18*b* of the peripheral wall 18. The bearing 21 is provided between the first side surface 18*c* of the peripheral wall 18 and an outer peripheral surface 15*a* of the rotary shaft 15. The bearing 21 is fixed to the first side surface 18*c* and the first end surface 18*d* of the peripheral wall 18.

The bearing 21 supports a part of the rotary shaft 15 in the axial direction X. Such a part of the rotary shaft 15 supported by the bearing 21 is referred to as a first shaft portion 15*b*. The rotary shaft 15 is rotationally supported in the shaft support housing 13 via the bearing 21. Thus, the rotary shaft 15 is rotationally supported in the housing 11.

Seal Member

A seal member 40 having an annular shape is provided in the shaft support housing 13 serving as the separation wall. The seal member 40 is made of a resin. The seal member 40 is positioned inside the second accommodation recess 17*b* of the end wall 17. The seal member 40 is provided between the second side surface 17*c* of the end wall 17 and the outer peripheral surface 15*a* of the rotary shaft 15. The seal member 40 is provided closer to the motor chamber S1 than the bearing 21 is, in the axial direction X of the rotary shaft 15.

The seal member 40 is in contact with the second side surface 17*c* of the end wall 17. The seal member 40 is in contact with a part of the rotary shaft 15 in the axial direction X. Such a part of the rotary shaft 15 being in contact with the seal member 40 is referred to as a second shaft portion 15*c*. An outer diameter L2 of the first shaft portion 15*b* is the same as an outer diameter L3 of the second shaft portion 15*c*. An outer diameter of the first shaft portion 15*b* is the same as that of the second shaft portion 15*c* in the axial direction X of the rotary shaft 15.

The seal member 40 is in contact with the shaft support housing 13 and the rotary shaft 15 to seal the back pressure chamber S3 and the motor chamber S1. Thus, the seal member 40 suppresses the refrigerant gas flowing between the back pressure chamber S3 and the motor chamber S1 via the second accommodation recess 17*b* and the insertion hole 17*a*.

When the motor-driven scroll type compressor 10 is in a steady state in which the pressure in the back pressure chamber S3 is greater than the pressure in the motor chamber S1, the seal member 40 is pressed against the second end surface 17*d* of the second accommodation recess 17*b* due to a pressure difference between the motor chamber S1 and the back pressure chamber S3.

Figure 3:
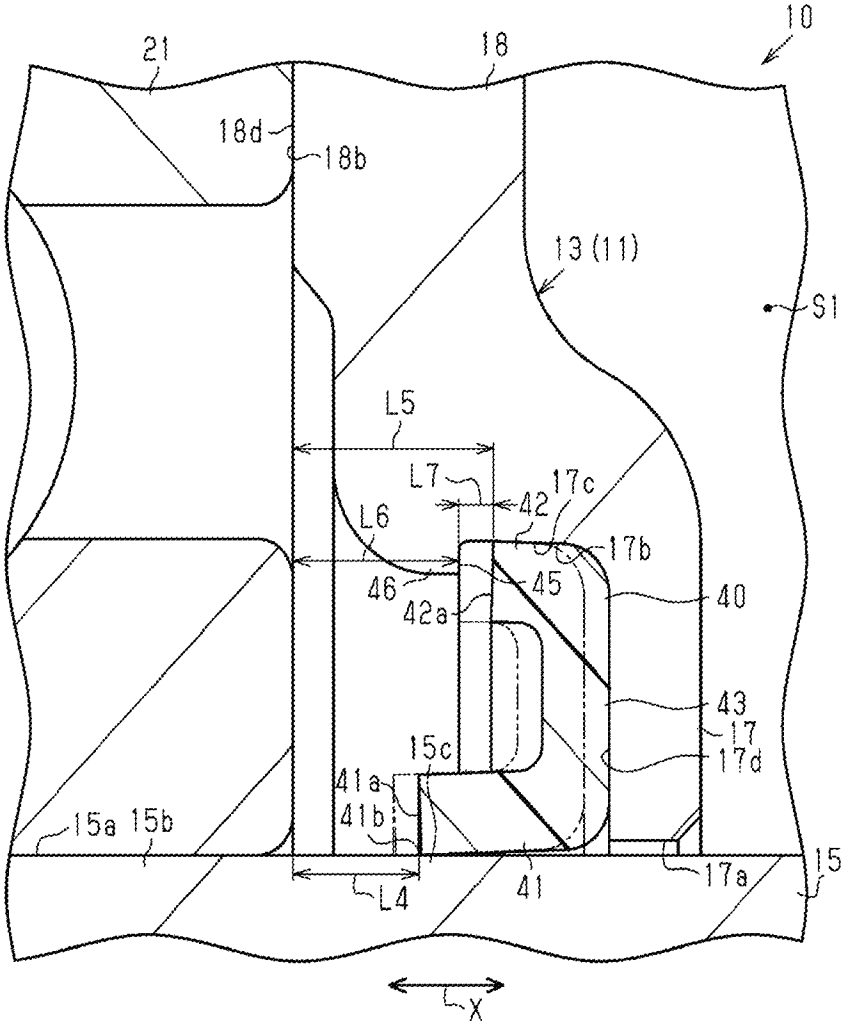
FIG. 3 is an enlarged cross-sectional view of a peripheral area including a bearing and a seal member.

As illustrated in FIG. 3, the seal member 40 includes an inner circumference seal portion 41 and an outer circumference seal portion 42. The seal member 40 further includes a connection portion 43 having an annular shape. The connection portion 43 extends in the radial direction of the rotary shaft 15. The connection portion 43 connects the inner circumference seal portion 41 and the outer circumference seal portion 42. The inner circumference seal portion 41, the outer circumference seal portion 42, and the connection portion 43 are formed integrally with each other.

The inner circumference seal portion 41 has an annular shape. The inner circumference seal portion 41 extends toward the bearing 21 from an inner circumferential edge of the connection portion 43 and approaches the outer peripheral surface 15*a* of the rotary shaft 15 as being away from the connection portion 43.

The inner circumference seal portion 41 has an end 41*a* directed toward the bearing 21. The end 41*a* of the inner circumference seal portion 41 is positioned on a side of the inner circumference seal portion 41 opposite to a connecting part between the inner circumference seal portion 41 and the connection portion 43. A part of the end 41*a* of the inner circumference seal portion 41 close to an inner circumferential surface of the inner circumference seal portion 41 serves as a contact portion 41*b* being in contact with the outer peripheral surface 15*a* of the rotary shaft 15. The contact portion 41*b* is in close contact with the outer peripheral surface 15*a* of the rotary shaft 15, so that the inner circumference seal portion 41 seals a gap between the inner circumference seal portion 41 itself and the rotary shaft 15. Such a part of the rotary shaft 15 being in contact with the contact portion 41*b* corresponds to the second shaft portion 15*c* that is a part of the rotary shaft 15 being in contact with the seal member 40.

The outer circumference seal portion 42 has an annular shape. The outer circumference seal portion 42 is disposed on a radially outward side of the rotary shaft 15 relative to the inner circumference seal portion 41. The outer circumference seal portion 42 extends toward the bearing 21 from an outer peripheral edge of the connection portion 43. The outer circumference seal portion 42 has an end 42*a* directed toward the bearing 21. The end 42*a* of the outer circumference seal portion 42 is positioned on a side of the outer circumference seal portion 42 opposite to a connecting part between the outer circumference seal portion 42 and the connection portion 43.

An outer peripheral surface of the outer circumference seal portion 42 is in close contact with the second side surface 17*c* of the end wall 17. The seal member 40 is fitted in the second accommodation recess 17*b* in a state in which the outer peripheral surface of the outer circumference seal portion 42 is in close contact with the second side surface 17*c* of the end wall 17. The outer peripheral surface of the outer circumference seal portion 42 is in close contact with the second side surface 17*c* of the end wall 17, so that the outer circumference seal portion 42 seals a gap between the outer circumference seal portion 42 itself and the shaft support housing 13 serving as the separation wall.

In a state where the seal member 40 is fitted in the second accommodation recess 17*b*, the end 41*a* of the inner circumference seal portion 41 and the end 42*a* of the outer circumference seal portion 42 face the bearing 21 in the axial direction X of the rotary shaft 15. A dimension L4 of a gap between the bearing 21 and the end 41*a* of the inner circumference seal portion 41 in the axial direction X of the rotary shaft 15 is smaller than a dimension L5 of a gap between the bearing 21 and the end 42*a* of the outer circumference seal portion 42 in the axial direction X of the rotary shaft 15. Thus, the end 41*a* of the inner circumference seal portion 41 is provided closer to the bearing 21 than the end 42*a* of the outer circumference seal portion 42 is, in the axial direction X of the rotary shaft 15.

Holding Portion

The shaft support housing 13 has a convex portion 46 protruding toward the rotary shaft 15 from the second side surface 17*c* of the end wall 17. The convex portion 46 has an annular shape. The convex portion 46 is positioned close to the bearing 21 relative to the outer circumference seal portion 42 in the axial direction X of the rotary shaft 15. The convex portion 46 has a holding portion 45 facing the end 42*a* of the outer circumference seal portion 42. That is, the holding portion 45 is provided in the shaft support housing 13 serving as the separation wall. The holding portion 45 is formed integrally with the shaft support housing 13. The holding portion 45 is an annular plane surface corresponding to an end surface of the convex portion 46 in the axial direction X of the rotary shaft 15. The holding portion 45 faces the end 42*a* of the outer circumference seal portion 42. The holding portion 45 is in contact with the end 42*a* of the outer circumference seal portion 42, which restricts movement of the seal member 40 toward the bearing 21.

Positions and Dimensions of Seal Portions

A dimension L7 of a gap between the holding portion 45 and the end 42*a* of the outer circumference seal portion 42 in the axial direction X of the rotary shaft 15 is smaller than the dimension L4 of a gap between the bearing 21 and the end 41*a* of the inner circumference seal portion 41 in the axial direction X of the rotary shaft 15. The dimension L4 between the bearing 21 and the end 41*a* of the inner circumference seal portion 41 in the axial direction X of the rotary shaft 15 is smaller than a dimension L6 between the bearing 21 and the holding portion 45 in the axial direction X of the rotary shaft 15. Thus, the end 41*a* of the inner circumference seal portion 41 is provided closer to the bearing 21 than the holding portion 45 is, in the axial direction X of the rotary shaft 15. A dimension of the outer circumference seal portion 42 in the axial direction X of the rotary shaft 15 is smaller than that of the inner circumference seal portion 41 in the axial direction X of the rotary shaft 15.

When the dimension of the inner circumference seal portion 41 in the axial direction X of the rotary shaft 15 is excessively large, the inner circumference seal portion 41 may be excessively in contact with the rotary shaft 15. When the dimension of the inner circumference seal portion 41 in the axial direction X of the rotary shaft 15 is excessively small, the seal member 40 may fall out of the second accommodation recess 17*b*. Thus, in the present embodiment, the dimension of the inner circumference seal portion 41 in the axial direction X of the rotary shaft 15 is set such that the inner circumference seal portion 41 is prevented from being excessively in contact with the rotary shaft 15 and the seal member 40 is prevented from falling out of the second accommodation recess 17*b*.

One of the dimension of the inner circumference seal portion 41 in the axial direction X of the rotary shaft 15 and the dimension of the outer circumference seal portion 42 in the axial direction X of the rotary shaft 15, which is larger, corresponds to a dimension of the seal member 40 in the axial direction X of the rotary shaft 15. In the present embodiment, since the dimension of the outer circumference seal portion 42 in the axial direction X of the rotary shaft 15 is smaller than that of the inner circumference seal portion 41 in the axial direction X of the rotary shaft 15, the dimension of the inner circumference seal portion 41 in the axial direction X of the rotary shaft 15 corresponds to the dimension of the seal member 40 in the axial direction X of the rotary shaft 15.

Operation of Embodiment

Next, an operation of the present embodiment will be described.

In the motor-driven scroll type compressor 10, for example, when the refrigerant gas is filled inside the motor-driven scroll type compressor 10, a vacuum drawing operation is performed to extract air from the inside of the motor-driven scroll type compressor 10 before the filling of the refrigerant gas. After the vacuum drawing operation, the refrigerant gas gradually fills in the motor chamber S1. When the motor-driven scroll type compressor 10 is in an unsteady state in which the pressure in the motor chamber S1 is greater than the pressure in the back pressure chamber S3, the seal member 40 may move toward the bearing 21 due to a pressure difference between the motor chamber S1 and the back pressure chamber S3 as indicated by a double-dotted line of FIG. 3. At this time, the end 42*a* of the outer circumference seal portion 42 is in contact with the holding portion 45, which restricts movement of the seal member 40 toward the bearing 21.

Effects of Embodiment

In the above-mentioned embodiment, the following effects are obtained.

(1) The shaft support housing 13 serving as the separation wall includes the holding portion 45 that faces and is in contact with the end 42*a* of the outer circumference seal portion 42 to restrict the movement of the seal member 40 toward the bearing 21. Thus, the end 42*a* of the outer circumference seal portion 42 is in contact with the holding portion 45, which restricts the movement of the seal member 40 toward the bearing 21. The end 41*a* of the inner circumference seal portion 41 is provided closer to the bearing 21 than the holding portion 45 is, in the axial direction X of the rotary shaft 15. As a result, the dimension of the outer circumference seal portion 42 in the axial direction X of the rotary shaft 15 is smaller than that of the inner circumference seal portion 41 in the axial direction X of the rotary shaft 15. The dimension of the seal member 40 in the axial direction X of the rotary shaft 15 is reduced as compared with a case in which the dimension of the outer circumference seal portion 42 in the axial direction X of the rotary shaft 15 is larger than that of the inner circumference seal portion 41 in the axial direction X of the rotary shaft 15. This downsizes the motor-driven scroll type compressor 10 in the axial direction X of the rotary shaft 15 while restricting the movement of the seal member 40 toward the bearing 21.

(2) The dimension L7 of a gap between the holding portion 45 and the end 42*a* of the outer circumference seal portion 42 in the axial direction X of the rotary shaft 15 is smaller than the dimension L4 of a gap between the bearing 21 and the end 41*a* of the inner circumference seal portion 41 in the axial direction X of the rotary shaft 15. Thus, even when the seal member 40 moves toward the bearing 21, the end 42*a* of the outer circumference seal portion 42 is in contact with the holding portion 45 before the end 41*a* of the inner circumference seal portion 41 is in contact with the bearing 21. As a result, the contact of the end 41*a* of the inner circumference seal portion 41 with the bearing 21 is suppressed, which can suppress deterioration in sealing performance of the inner circumference seal portion 41 for the rotary shaft 15.

(3) The outer diameter L2 of the first shaft portion 15*b* that is a part of the rotary shaft 15 supported by the bearing 21 is the same as the outer diameter L3 of the second shaft portion 15*c* that is a part of the rotary shaft 15 being in contact with the inner circumference seal portion 41. This eliminates a concave portion that is formed at a boundary between the first shaft portion 15*b* and the second shaft portion 15*c* of the rotary shaft 15 to release a polishing roller during polishing of the rotary shaft 15. As a result, the dimension of the rotary shaft 15 between the first shaft portion 15*b* and the second shaft portion 15*c* in the axial direction X of the rotary shaft 15 is reduced by a space due to elimination of the concave portion. Thus, the motor-driven scroll type compressor 10 is further downsized in the axial direction X of the rotary shaft 15.

(4) The rotary shaft 15 includes the balance weight 32 for offsetting the centrifugal force applied to the orbiting scroll 26 in response to the rotation of the rotary shaft 15. The balance weight 32 is disposed between the electric motor 22 and the shaft support housing 13 serving as the separation wall in the axial direction X of the rotary shaft 15. The end 41*a* of the inner circumference seal portion 41 is provided closer to the bearing 21 than the holding portion 45 is, which downsizes the motor-driven scroll type compressor 10 in the axial direction X of the rotary shaft 15. As a result, the balance weight 32 approaches the bearing 21 in the axial direction X of the rotary shaft 15. The distance between the orbiting scroll 26 and the balance weight 32 in the axial direction X of the rotary shaft 15 is reduced, which reduces a weight of the balance weight 32 required for offsetting the centrifugal force applied to the orbiting scroll 26 in response to the rotation of the rotary shaft 15. Thus, weight reduction of the balance weight 32 leads to weight reduction of the motor-driven scroll type compressor 10.

(5) The rotary shaft 15 includes the balance weight 32 for offsetting the centrifugal force applied to the orbiting scroll 26 in response to the rotation of the rotary shaft 15. The balance weight 32 is disposed between the electric motor 22 and the shaft support housing 13 serving as the separation wall in the axial direction X of the rotary shaft 15. The dimension of the rotary shaft 15 is reduced between the first shaft portion 15*b* that is a part of the rotary shaft 15 supported by the bearing 21 and the second shaft portion 15*c* that is a part of the rotary shaft being in contact with the inner circumference seal portion 41 in the axial direction X of the rotary shaft 15. Thus, the balance weight 32 approaches the bearing 21 in the axial direction X of the rotary shaft 15. The distance between the orbiting scroll 26 and the balance weight 32 in the axial direction X of the rotary shaft 15 is reduced, which reduces the weight of the balance weight 32 required for offsetting the centrifugal force applied to the orbiting scroll 26 in response to the rotation of the rotary shaft 15. As a result, weight reduction of the balance weight 32 leads to weight reduction of the motor-driven scroll type compressor 10.

Modified Embodiment

The above-mentioned modified embodiment can be modified and implemented as follows. The above-mentioned embodiment may be combined with the following modified embodiment within technically consistent range.

The balance weight 32 need not be disposed at a position between the electric motor 22 and the shaft support housing 13 in the axial direction X of the rotary shaft 15. For example, the balance weight 32 may be disposed in the back pressure chamber S3.

The balance weight 32 may be omitted from the rotary shaft 15.

The outer diameter L2 of the first shaft portion 15*b* may be greater than the outer diameter L3 of the second shaft portion 15*c*, or may be smaller than the outer diameter L3 of the second shaft portion 15*c*. In this case, a concave portion releasing the polishing roller during polishing of the rotary shaft 15 may be formed at the boundary between the first shaft portion 15*b* and the second shaft portion 15*c* of the rotary shaft 15.

The dimension L7 of a gap between the holding portion 45 and the end 42*a* of the outer circumference seal portion 42 in the axial direction X of the rotary shaft 15 may be equal to or greater than the dimension L4 of a gap between the bearing 21 and the end 41*a* of the inner circumference seal portion 41 in the axial direction X of the rotary shaft 15.

The holding portion 45 may be a separate member from the shaft support housing 13. For example, a circlip may be disposed on the shaft support housing 13 serving as the separation wall, and the holding portion 45 may be provided at the circlip, so that the holding portion 45 is a separate member from the shaft support housing 13. In this case, an annular groove is formed on the second side surface 17*c* of the end wall 17, for example, and the circlip is attached to such a groove. The holding portion 45 at the circlip is the annular plane surface corresponding to the end surface of the circlip in the axial direction X of the rotary shaft 15. In this case, the holding portion 45 also faces the end 42*a* of the outer circumference seal portion 42.

The bearing 21 need not be a rolling bearing, and may be a sliding bearing, for example.

In the present embodiment, the motor-driven scroll type compressor 10 is used for the vehicle air conditioner, but may be used for any devices other than the vehicle air conditioner. For example, the motor-driven scroll type compressor 10 may be mounted on a fuel cell vehicle, and may be configured to compress air serving as fluid supplied to a fuel cell.

What is claimed is:

1. A motor-driven scroll compressor comprising:

a housing;

a rotary shaft rotationally supported in the housing;

an electric motor rotating the rotary shaft; and a compression part including a fixed scroll fixed to the housing and an orbiting scroll revolving in response to the rotation of the rotary shaft while being meshed with the fixed scroll, wherein the housing includes a separation wall separating a back pressure chamber from a motor chamber accommodating the electric motor, the back pressure chamber from which a back pressure for urging the orbiting scroll toward the fixed scroll is applied, the separation wall having an insertion hole into which the rotary shaft is inserted, and the separation wall includes a bearing rotationally supporting the rotary shaft, and a seal member that has an annular shape and includes an inner circumference seal portion sealing a gap between the inner circumference seal portion and the rotary shaft and an outer circumference seal portion sealing a gap between the outer circumference seal portion and the separation wall, the seal member sealing the back pressure chamber and the motor chamber, wherein each of the inner circumference seal portion and the outer circumference seal portion has an end directed toward the bearing, the end of the inner circumference seal portion is provided closer to the bearing than the end of the outer circumference seal portion is, the separation wall includes a holding portion that faces the end of the outer circumference seal portion, wherein the end of the inner circumference seal portion is provided closer to the bearing than the holding portion is, when the motor-driven compressor is in an unsteady state in which a pressure in the motor chamber is greater than a pressure in the back pressure chamber, end of the outer circumference seal portion is in contact with the holding portion, which restricts movement of the seal member toward the bearing, and when the motor-driven compressor is in a steady state in which the pressure in the back pressure chamber is greater than the pressure in the motor chamber, the end of the outer circumference seal portion is not in contact with the holding portion.

2. The motor-driven scroll compressor according to claim 1, wherein when the motor-driven scroll compressor is in the steady state in which pressure in the back pressure chamber is greater than pressure in the motor chamber, a dimension of a gap between the holding portion and the end of the outer circumference seal portion in an axial direction of the rotary shaft is smaller than a dimension of a gap between the bearing and the end of the inner circumference seal portion in the axial direction of the rotary shaft.

3. The motor-driven scroll compressor according to claim 1, wherein an outer diameter of a part of the rotary shaft supported by the bearing is the same as an outer diameter of a part of the rotary shaft being in contact with the inner circumference seal portion.

4. The motor-driven scroll compressor according to claim 1, wherein the rotary shaft includes a balance weight offsetting a centrifugal force applied to the orbiting scroll in response to the rotation of the rotary shaft, and the balance weight is disposed between the separation wall and the electric motor in the axial direction of the rotary shaft.

5. The motor-driven scroll-compressor according to claim 3, wherein the rotary shaft includes a balance weight offsetting a centrifugal force applied to the orbiting scroll in response to the rotation of the rotary shaft, and the balance weight is disposed between the separation wall and the electric motor in the axial direction of the rotary shaft.

* * * * *